United States Patent [19]

De Graw et al.

[11] Patent Number: 4,739,525

[45] Date of Patent: Apr. 26, 1988

[54] SELF-CONTAINED TOILET SYSTEM

[75] Inventors: Kenneth J. De Graw, Montvale; Brian Wilcockson, Wayne; Steve Proios, Northvale, all of N.J.

[73] Assignee: American Standard, Inc., New York, N.Y.

[21] Appl. No.: 841,048

[22] Filed: Mar. 17, 1986

Related U.S. Application Data

[63] Continuation of Ser. No. 743,290, Jun. 11, 1985, abandoned, which is a continuation of Ser. No. 411,430, Aug. 25, 1982, abandoned.

[51] Int. Cl.[4] ..... E03D 9/10

[52] U.S. Cl. ..... 4/319; 241/46.06; 241/46.17

[58] Field of Search ..... 4/319, 320; 241/46.06, 241/46.17; 415/121 B

[56] References Cited

U.S. PATENT DOCUMENTS

| | | | |
|---|---|---|---|
| 2,718,012 | 9/1955 | Howe . | |
| 2,951,449 | 9/1960 | Van Blarcom, Jr. et al. . | |
| 3,103,177 | 9/1963 | Gatto et al. . | |
| 3,128,051 | 4/1964 | Smith . | |
| 3,229,641 | 1/1966 | Hessler . | |
| 3,318,248 | 5/1967 | Rembold . | |
| 3,323,650 | 6/1967 | Kilbane, Jr. . | |
| 3,361,369 | 1/1968 | Ruble . | |
| 3,375,983 | 4/1968 | Von Eiff et al. . | |
| 3,380,673 | 4/1968 | Van Lenten et al. . | |
| 3,384,026 | 5/1968 | Williamson, Jr. . | |
| 3,397,410 | 8/1968 | Cella . | |
| 3,429,951 | 2/1969 | Gribble . | |
| 3,589,623 | 6/1971 | Belden . | |
| 3,643,877 | 2/1972 | Zimmer . | |
| 3,673,614 | 7/1972 | Claunch . | |
| 3,699,592 | 10/1972 | Minchak . | |
| 3,713,177 | 1/1973 | Tufts et al. | 4/320 |
| 3,722,803 | 3/1973 | Kemper . | |
| 3,738,581 | 6/1973 | Gallauresi et al. . | |
| 3,785,574 | 1/1974 | Rosenquest, Jr. . | |
| 3,878,569 | 4/1975 | Peirish, Jr. et al. . | |
| 3,939,499 | 9/1976 | Roberts . | |
| 3,943,044 | 3/1976 | Fenn et al. . | |
| 3,975,247 | 8/1976 | Stralser . | |
| 4,012,322 | 3/1977 | Saigh et al. | 4/320 X |
| 4,014,767 | 3/1977 | Schmidt . | |
| 4,159,550 | 7/1979 | Tobin | 4/319 |
| 4,214,324 | 7/1980 | Kemper et al. . | |
| 4,216,554 | 8/1980 | Glueckert et al. | 4/323 |
| 4,246,665 | 1/1981 | Albertassi et al. | 4/320 X |
| 4,333,185 | 6/1982 | Heinze et al. | 4/319 |

*Primary Examiner*—Charles E. Phillips
*Attorney, Agent, or Firm*—Hoffman & Baron

[57] ABSTRACT

A self-contained system including a housing structure and a toilet bowl in the housing structure adapted to receive human waste and fluid for diluting the waste, transporting the waste and rinsing the bowl. A macerator is in the housing in communication with the toilet bowl. Discharge structure is provided for removing effluent fluid from the system. The system provides for flushing the bowl and dumping the contents into the macerator for conditioning of the solids. The bowl is subsequently refilled. Fluid is transported by pump from the exterior of the system to the bowl for flushing and refilling thereof, and for transporting effluent fluid from the macerator to the exterior of the system. Controls are provided for directing the fluid through the system and facilitating the handling of waste and transportion of the treated waste to the exterior of the system. The system is designed to transport fluid to an elevated or remote location. It is also a significant water saver.

13 Claims, 12 Drawing Sheets

SELF-CONTAINED TOILET SYSTEM

This is a continuation of co-pending application Ser. No. 743,290, filed on June 11, 1985, which in turn is a continuation application of U.S. Ser. No. 411,430, filed Aug. 25, 1982, both now abandoned.

BACKGROUND OF THE INVENTION

There are limitations in the locations where standard toilets can be used. For example, basement locations present significant problems, particularly when the existing sewage pipes are above the basement floor. To install a conventional toilet, it is presently necessary to conduct a number of costly procedures in order to produce an acceptable installation. For example, the basement floor must be torn up in order to ihstall large diameter waste plumbing and a receiver tank. Additionally, special grinder type pumps (commonly known as sewer ejectors) are needed to facilitate disposal of the waste by lifting it to the sewage pipe. In addition, the receiver tank must be vented to prevent odors from escaping.

Clearly systems of this type are not economic and are quite complex and difficult to construct and maintain. They generally require a significant addition to power consumption as well. In view of the complexity, the size of the installation becomes quite large and bulky as well as being difficult to assemble and maintain. There is certainly room for improvement.

The same type of situation exists where toilets are to be located remote from existing sewage pipes. In particular, special large diameter plumbing lines are required. Once again, cost becomes a significant factor particularly in regard to installation, maintenance and operating expenses.

It should also be kept in mind that water savings are an ultimate objective in all environments today. This is true in regard to systems requiring specialized plumbing such as discussed above and to systems requiring generally known plumbing. Any system that produces significant water savings is attractive to those interested in waste disposal today and represents a significant improvement. The advantages of a low water use toilet are threefold. First, less fresh water is required thereby reducing demands on public water supples or private wells. Second, marginal septic systems can be greatly aided by reducing the hydraulic load placed on them compared to conventional toilets. Thirdly, public sewer systems are likewise aided.

SUMMARY OF THE INVENTION

With the above background in mind, it is among the primary objectives of the present invention to provide a toilet system that is capable of disposing of toilet tissue paper and human waste from a basement location to a sewer or septic tank line located up to and including 10 feet above the basement floor.

It is an objective to provide a self-contained low cost toilet system which eliminates the need for tearing up basement floors, requires no special grinder type pumps, or special sewage pits. The system requires simple tools and skills for hook-up, therefore, it is easy to install and operates automatically. Accordingly, it is simple to operate, it is quick in that it recovers in less than 15 seconds, and is quiet in operation. Also, the system is a water-saver since it uses approximately 8 quarts per flush.

Basically, the system is designed to receive its flushing water from a household water line through a conventional solenoid water valve. The water pressure directs the water through an anti-syphon valve and into the toilet bowl during the flushing sequence. The bowl water, including the waste material, is drawn into and through the flexible blades of its pump. The pump features both chopping and lifting capability: the waste material is chopped to small pieces by the pump's impeller, and is pushed through a 1½ inch plastic pipe to the height necessary to reach the septic tank or sewer pipe above the floor.

It is a further objective of the invention to provide a system of low cost economic construction utilizing a minimum number of low cost components which can be easily and quickly assembled. The resultant system is designed for unlimited trouble-free and dependable service. It is operated by simply pushing a flush button on the exterior of the housing. Suitable electrical controls are employed to facilitate operation of the system. Simple adjustment will compensate for differences in floor to sewer pipe location between four feet and ten feet.

The system is designed so that only approximately eight quarts of water is utilized per flush. Also, power consumption is minimal.

A further objective of the system is to provide an exterior housing for the system which is compact in nature and provides ease of access to the interior for maintenance purposes.

The system is designed to be operated by the use of an external, easily accessible push button which is used to instigate the flush cycle. Thus, operation of the system is simply actuated by pushing the flush button whereupon pushing of this button momentarily will automatically actuate the circuit components to satisfy the following sequential order. The rinse water enters the bowl, the bowl contents are drawn into the flexible impeller pump where the waste solids and paper are chopped and the resultant effluent is then pumped in the sewer or septic tank line above the floor. The bowl will be refilled automatically in preparation for initiation of the next operational sequence of the system. The cycle takes less than 15 seconds and utilizes approximately 8 quarts of water per flush.

With this in mind, the system can be adapted for use with a waste disposal system including a toilet and a conventional type of tank used as part of the system to store the liquid for each flush. Flushing is accomplished by interlocking the flush tank with the pump. In place of the storage tank arrangement direct communication can be made to conventional household water lines with appropriate shut-off valves. When appropriate, a solenoid valve and a syphon break are employed to directly introduce liquid for the flush to the toilet portion of the waste disposal system.

One of the major applications for the toilet is for use in a basement. In this application, the effluent discharge from the toilet is directed upward through the vertical piping to a sewer pipe located above the toilet. Also, along the same lines, the present system can be used where the toilet is located at a significant distance from a sewer pipe, that is, a remote location, without the necessity of running large diameter plumbing lines. In this type of system, the toilet can be used for invalid or elderly use on a temporary or permanent basis. Furthermore, the toilet system can be added by a simple do-it-yourself process in any remote location such as the bedroom or the attic.

To use the toilet system in a basement location with the sewage pipe above the toilet facility or at a remote location, a macerator pump provides the pumping requirements for discharge. The macerator pump includes structure to permit the pumping of solid objects and to permit the pumping of solids and macerated solids and liquid to elevated locations. The pump is designed with a cutting block on the interior to provide chopping or maceration of soft solids and to provide pump lift capabilities. A rotating impeller is provided in the pump with flexible blades or blades with flexible tips to cooperate with the cutting block to provide pumping action, for discharge and for maceration of solids which are easily chopped. The cutting block can be provided with a variety of different surface configurations to facilitate the chopping and cutting action.

Another form of this system enables it to be used in place of a conventional type of toilet system and to permit the water volume for flush to be reduced from 5 or 3½ gallons down to ½ gallon. This is particularly useful in areas where there is a water shortage or where there is only marginal septic tank operation available.

In summary, a self-contained toilet system is provided. The system includes a housing structure and a toilet bowl mounted on the housing structure and adapted to receive human waste and a rinse/refill means to transport the waste and rinse the bowl. A pump is in the housing in communication directly with the toilet bowl.

With the above objectives among others in mind, reference is made to the attached drawings.

DETAILED DESCRIPTION

Figure 1:
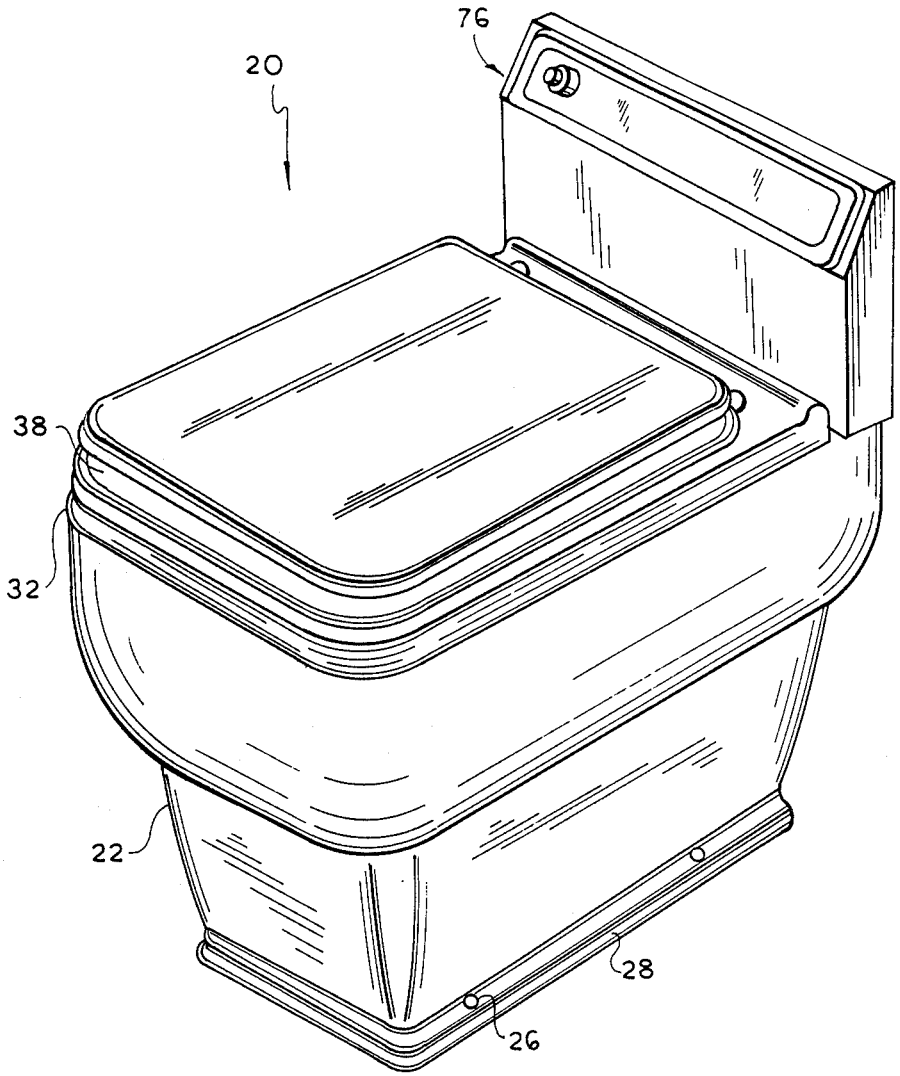
FIG. 1 is a perspective view of the self-contained sewage waste disposal system of the present invention.
Figure 2:
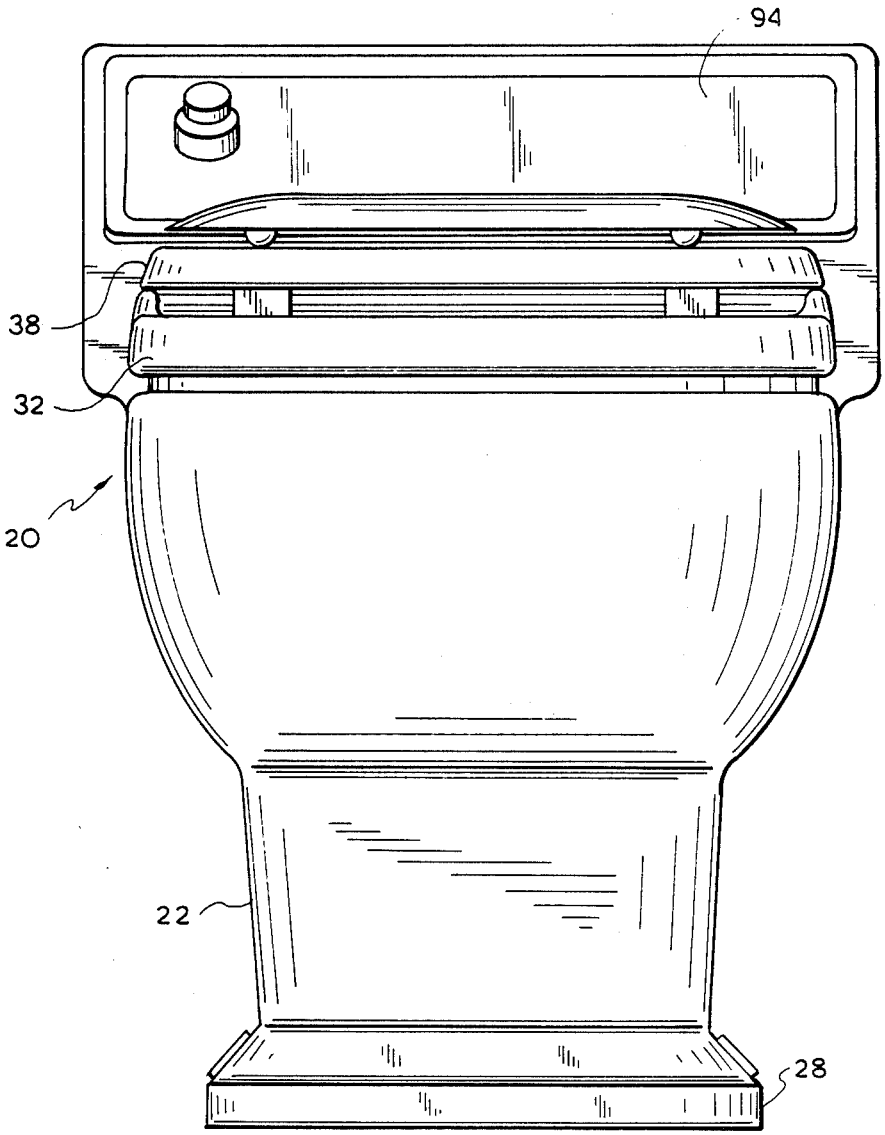
FIG. 2 is a front elevation view thereof.
Figure 3:
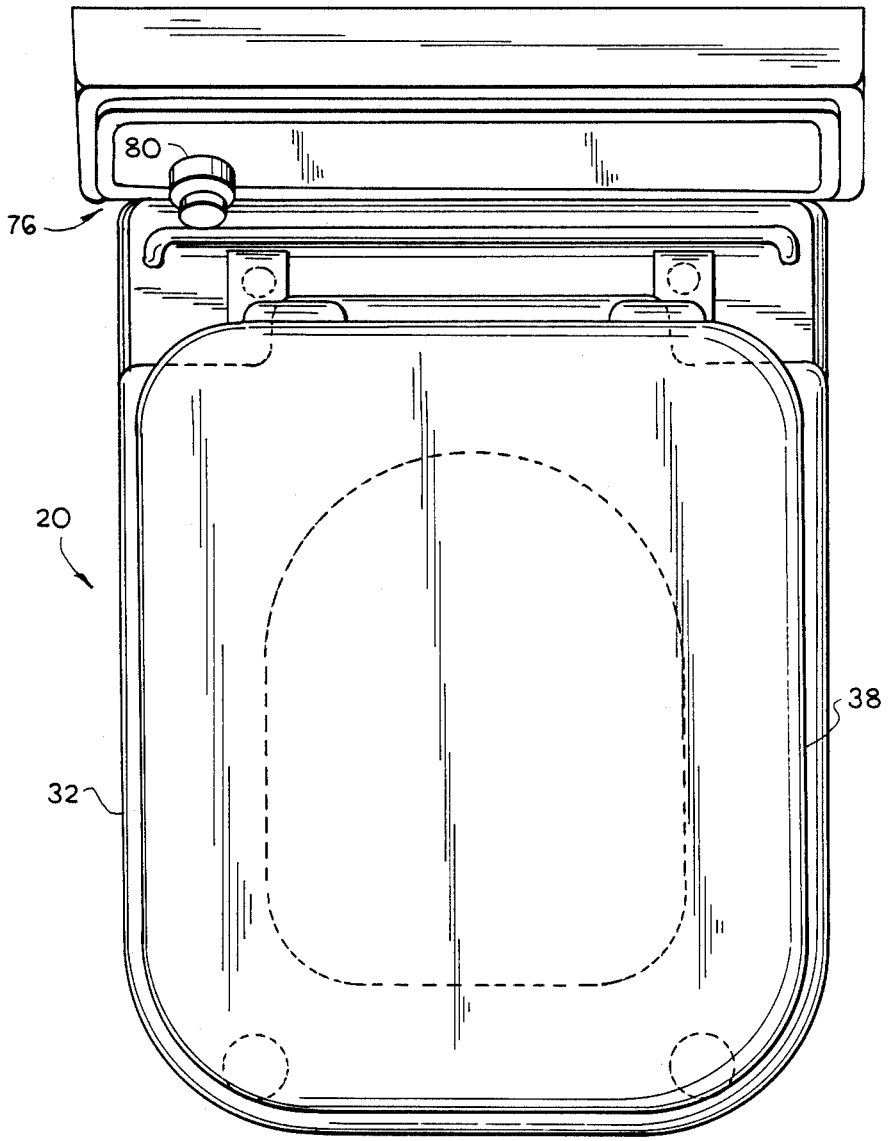
FIG. 3 is a top plan view thereof.
Figure 4:
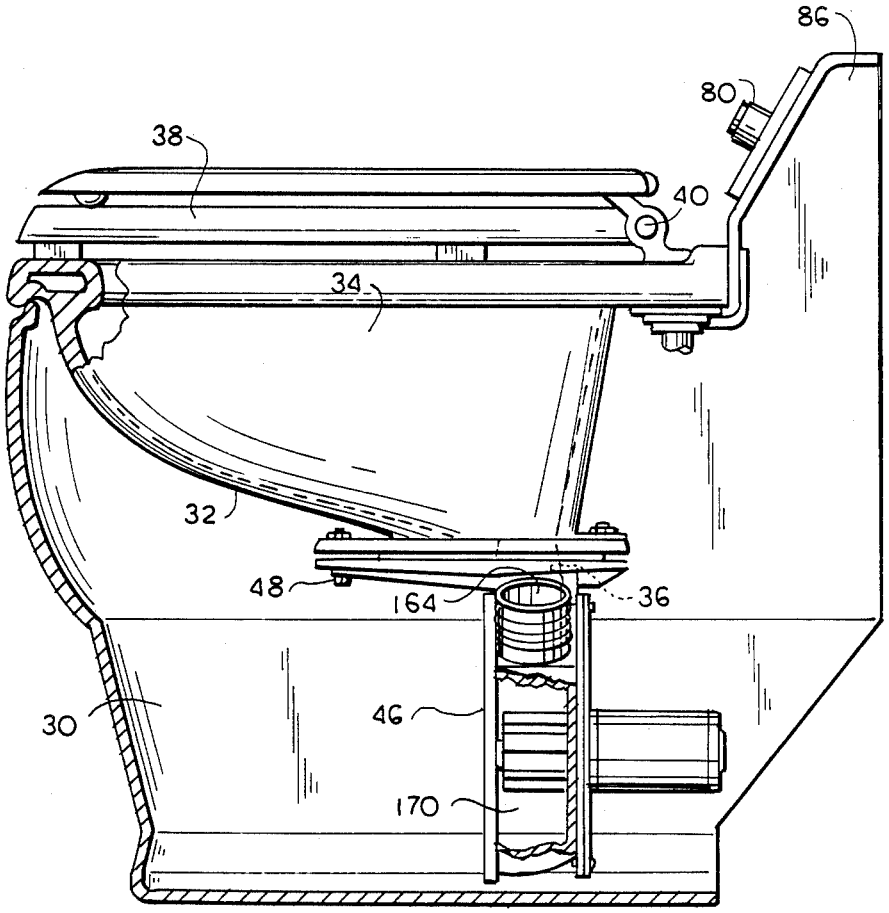
FIG. 4 is a sectional side view thereof.

Waste disposal system 20 includes an exterior housing 22 formed of a conventional structural material such as fiberglass. A plurality of spaced suitable bolts are employed to mount the housing 22 in fixed position at the location of use. For example, it can be mounted directly to the floor. Mounting holes 26 for the bolts are spaced around the periphery of a base flange 28 of the housing.

The housing has a hollow interior 30 and a toilet bowl assembly 32 mounted therein. The toilet bowl is a conventional bowl of material such as vitreous china. The toilet bowl has a central aperture 34 in its upper end and a smaller discharge opening 36 at its lower end. Mounted on the housing in overlying relationship with respect to the aperture 34 in the toilet bowl is a conventional toilet seat and cover assembly 38. The seat and cover assembly 38 is mounted in a conventional manner so as to be hinged about pivot pin 40 to permit the opening and closing of the cover and the seat with respect to the bowl.

The remainder of the system is also mounted on bowl 32. For example, a pump macerator assembly 46 is bolted to the bowl by conventional bolt assemblies 48.

Figure 6:
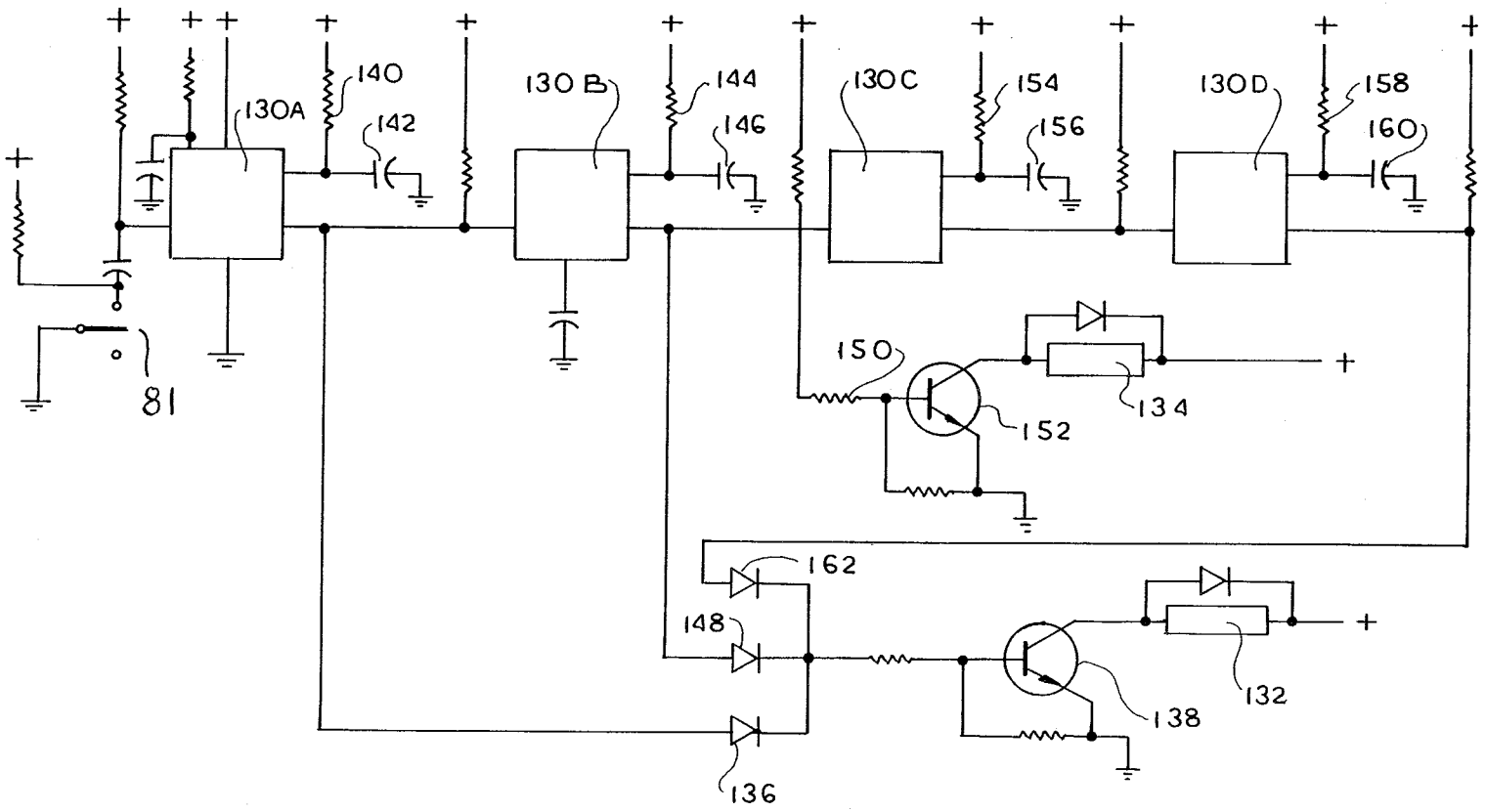
FIG. 6 is a schematic drawing of the electrical control circuitry of the system.

The electrical controls for system 20 operates through electrical control panel 86 and function in the following manner as shown in FIG. 6. The system employs an NE558 monolithic timing device 130. This device contains four circuits 130A, 130B, 130C, and 130D which can be used to produce four entirely independent timing functions. A capacitor and resistor combination achieves the timing function.

In connection with assembly 20, the timer 130 is used primarily in a monostable (one shot time delay) mode. The same device may be used as a set-reset flip-flop. This is achieved by leaving the timing capacitor out, therefore, essentially the monostable has timing of 0 seconds.

When timer 130 is used in the one-shot mode operation, it is necessary to supply a resistor and capacitor for timing. The time period is equal to the product of the number of ohms in the resistor and the number of farads in the capacitor. Since the output structure of the timer 130 is an open collector, it requires an output pull-up resistor. The output is normally low and is switched high when triggered. A trigger (start the timing) is achieved on the falling edge of a trigger pulse only after previously being high. A reset is also available in each device to reset all sections simultaneously to an output low state. When the reset function is low, all output set low and the trigger is inhibited.

Whenever the timing output of timer 130 is needed to drive a relay, a high gain/high power D4OKÍ MPN transistor is used. Diodes are used across each relay coil to suppress the transient voltage produced when de-energized. Diodes are also used across motors, pumps, and valves, to suppress transient voltages. A flush valve relay 132 and a macerator pump relay 134 are employed in the system.

Figure 6A:
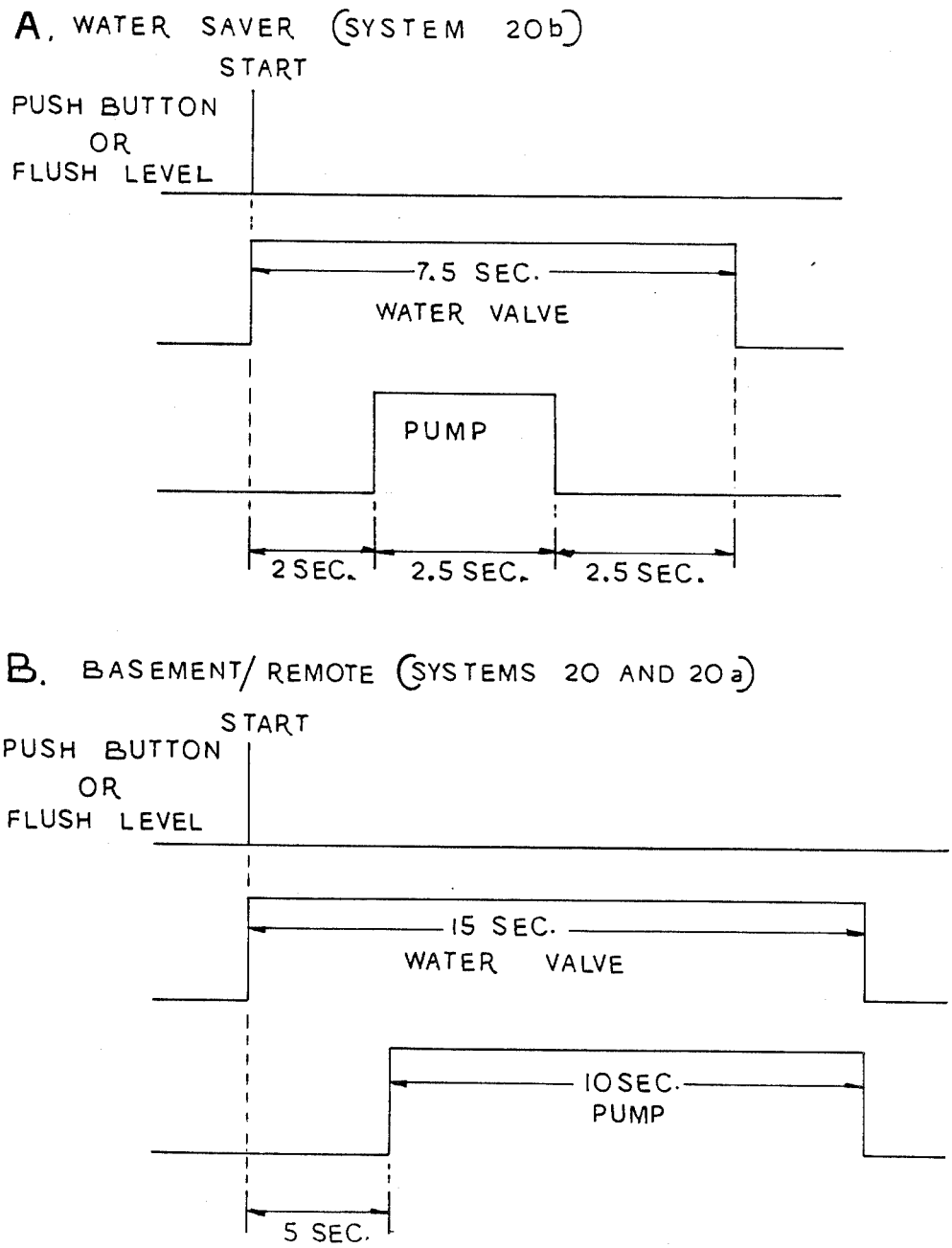
FIG. 6A is a schematic arrangement of the timing sequences of the system.

Flush button 80 exposed on the exterior of the housing is attached to a spring return switch 81. Alternatively, a flush lever can be employed. When flush button 80 is pushed inward, it initiates a flush in the following manner. The timing sequence can be observed in FIG. 6A.

Timer 130A output goes high immediately upon pushing flush button 80 inward. Through diode 136, the output of timer 130A saturates transistor 138, which pulls flush valve relay 132 in. Its period is timed by resistor 140 and capacitor 142, 5 seconds if the system is being used in a basement location (assembly 20) or in a remote location (assembly 20*a*) with respect to the sewage disposal lines and 2 seconds if the system is being used in a conventional type of disposal system but employing low water volume use (assembly 20*b*).

When timer 130A completes its timing, timer 130B starts its timing as determined by resistor 144 and capacitor 146 for 10 seconds for basement and remote uses (assembly 20 and 20*a*) and 7.5 seconds for low water volume use (assembly 20*b*). Through diode 148, the output of timer 130B keeps transistor 138 saturated, keeping flush valve relay 132 in. Also through resistor 150, the output of timer 130B saturated transistor 152 pulling macerator pump relay 134 in.

This completes the "rinse" interval of the assembly 20 which accomplishes the following sequence. Pushing flush button 80 downward open the solenoid valve allowing water from the water supply into the bowl. 2 or 5 seconds later depending upon the use, the macerator pump is powered evacuating the bowl of contents while the solenoid valve is rinsing the bowl for an additional 7.5 or 10 seconds depending on the use.

When timer 130B goes low, it forces timer 130C high. The period for timer 130C is timed by resistor 154 and capacitor 156 at 0 seconds. (capacitor 156 is left out).

After the set-reset flip-flop 130C resets, timer 130D output goes high and stays high for 2.5 seconds for use in a low water volume system as determined by resistor 158 and capacitor 160. Through diode 162, the output of timer 130D saturates transistor 138, pulling flush valve relay 132 in. Flush valve relay 132 powers the flush valve pushing water from the water supply into the bowl for 2.5 seconds. This is the "refill" interval of the assembly 20 which refills the bowl to its wet level. The refill interval for the basement use system is 0 seconds. The wet level is achieved by the back wash of the water in the pipe.

Figure 7:
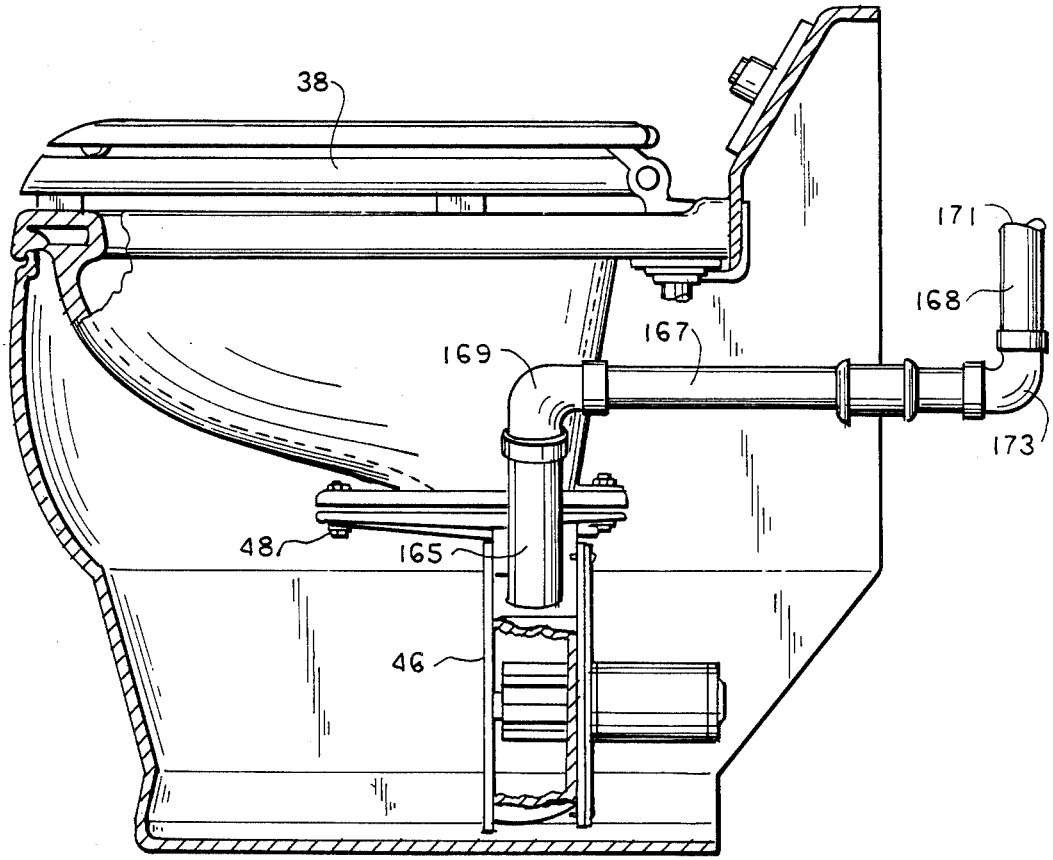
FIG. 7 is a sectional side view of the sewage waste disposal system of the invention showing the pipe connecting the system to an elevated sewage pipe.

FIG. 7 depicts the system 20 connected for use in a basement location. System 20 is provided with means for elevating the effluent to an elevated sewage pipe. The sewage pipe is interconnected with a vertical extending pipe arrangement 168 extending from a discharge opening in toilet assembly 20.

Pipe arrangement 168 includes a first vertical length 165 connected to fitting 164 surrounding discharge or outlet opening 176 in the working chamber 170 of macerator assembly 46. A second horizontal length 167 is connected to vertical length 165 by elbow joint 169 and extends exteriorally of the housing of the assembly through an appropriate aperture. A vertical length 171 is connected to horizontal length 167 by elbow joint 173 and extends upward from the basement to connection with an elevated existing waste pipe (not shown).

Since the effluent from the waste disposal system 20 must be elevated through pipe arrangement 168 for discharge through the elevated existing waste pipe, it is necessary that the macerator pump assembly 46 facilitate the pumping of the effluent upward.

Appropriate check valves and piping diameter and lengths can be employed so that there is no danger of overflowing the bowl by backflow through vertical conduit system 168.

Figure 8:
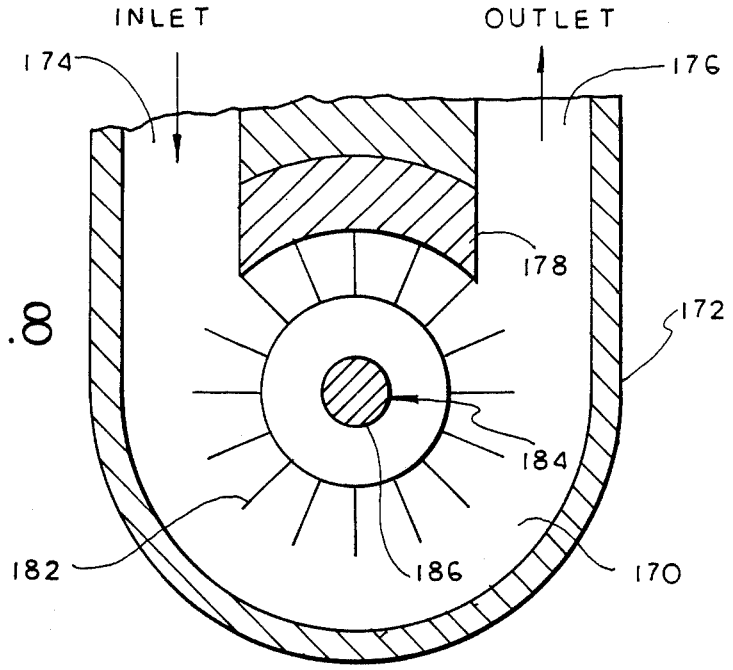
FIG. 8 is a fragmentary sectional view of the macerator pump assembly portion of the invention.

The details of macerator assembly 46 which permit the pumping of solid objects and to elevate solids and macerated solids and liquids is depicted in FIGS. 8–1. The interior chamber 170 is formed in pump body 172. The pump body is provided with an inlet opening 174 communicating with discharge opening 36 in the bowl assembly 32 and an outlet opening 176 communicating with discharge conduit arrangement 168. A chopping block 178 is provided with an arcuate inner cutting surface 180 for engagement with a plurality of blades 182 mounted on a rotatable impeller 184. The impeller rotates in the pump on a rotatable shaft 186 so that the blades are consecutively brought into cutting contact with the arcuate surface 180 of the block 178. The blades are formed of flexible material or can be formed with a rigid inner portion and flexible tips.

Block 178 provides chopping or maceration of soft solids and provides pump lift capacity. The tips 182 provide the pumping action, provide for discharging solid objects which cannot be macerated, and provide maceration of solids which are easily chopped.

Figure 9:
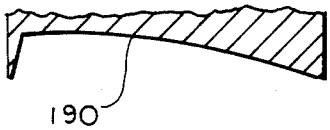
FIG. 9 is a fragmentary sectional view of an alternative form of the cutting block portion of the pump assembly of FIG. 8.
Figure 10:
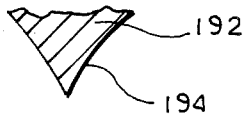
FIG. 10 is a fragmentary sectional view of a second alternative form of the cutting block portion of the pump assembly of FIG. 8.
Figure 11:
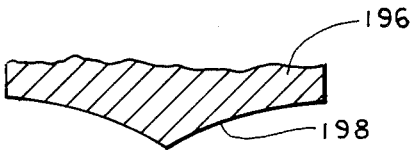
FIG. 11 is a fragmentary sectional view of a third alternative form of the cutting block portion of the pump assembly of FIG. 8.

Alternative block configurations are depicted in FIGS. 9–11. In FIG. 9, the block 188 has a differently shaped inner arcuate chopping surface 190 from that of block 178. Block 192 of FIG. 10 has a V-shaped chopping surface 194 and is of narrower diameter. The block 196 of FIG. 11 is of wider diameter and includes a V-shaped chopping surface 198.

The macerator assembly 46 is particularly useful when the toilet system is one which is subject to abuse by the addition of foreign objects which could damage certain types of macerator blade designs. That type of damage generally requires extensive maintenance or even a replacement in total of the pump unit before the toilet becomes operable again.

If the system is designed so that the macerator section is kept separate from the discharge portion of the pump, there is a need for more components, seals, housings, etc. and usually a double ended motor with a transfer port between the chamber or a motor with an extended shaft in which the chambers are mounted in tandem and have interconnecting passageways. That type of system is extremely expensive.

Alternatively due to the dual purpose function of the blade, there would be a necessity for excessive clearance in the chamber to achieve the chopping which can lead to a build-up of materials around the shaft or blade boss which detracts from the pumping performance and ultimately affects the maceration action. In both cases, the pump manufacturers specifically state that foreign objects must not be deposited in the toilet. However, even this can happen either accidentally or deliberately. Naturally an inoperative toilet can cause many problems in any environment.

Macerator pump assembly 46 avoids these difficulties and allows for maceration and discharge of normal usage and, by virtue of its internal arrangement, allows more solid objects to be discharged without attempting maceration and thus avoiding damage to the pump and the need for extensive repairs.

In addition, by virtue of the design and insertion of the block, the pump has lift potential and can be used to elevate liquids, solids and slurries to a predetermined height, for example approximately 10 feet, which makes the pump suitable for installation in basements, cellars, etc. where the waste materials from toilets, and the like can be effluented to soil pipes which are above the point of discharge of such apparatus. The various configurations of the block permit chopping, pumping or a combination of the two.

Figure 12:
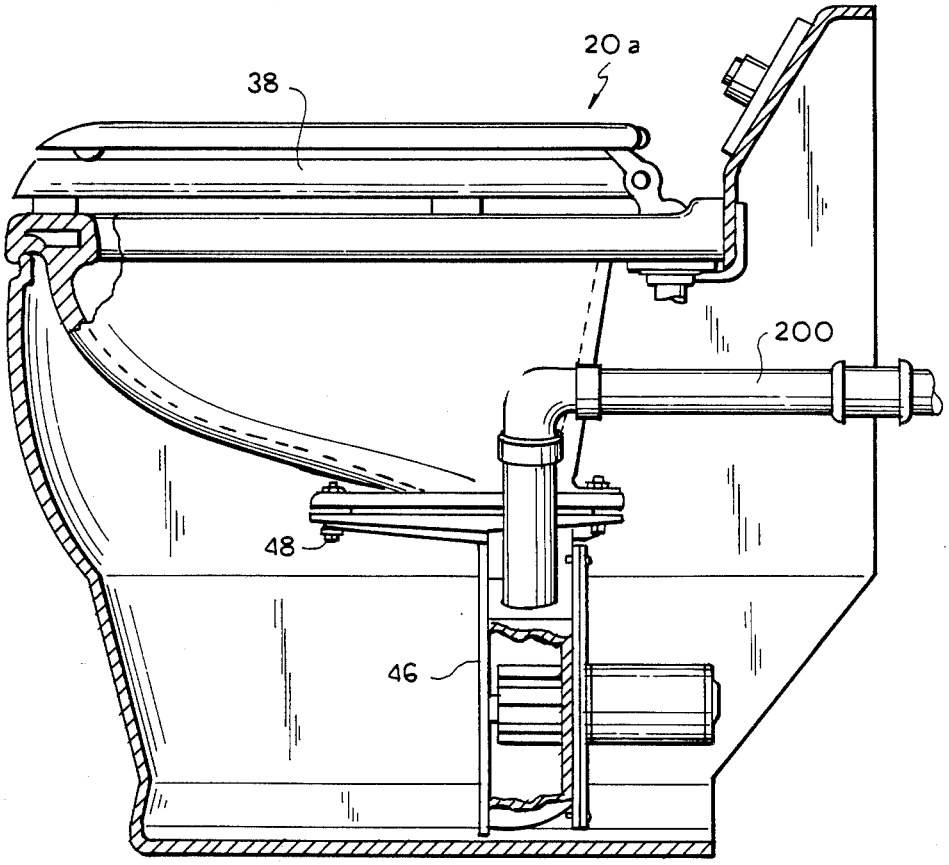
FIG. 12 is a sectional side elevation view of an alternative embodiment of the sewage waste disposal system of the invention showing a pipe connecting the system to a remote sewage pipe.

By varying the motor speed, impeller and block configurations, the pump unit can be utilized for other uses, such as low volume flushing toilets, etc. or as a separate pumping device for general application. The same type of pump used in assembly 20 is equally adaptable for other remote uses as depicted in assembly 20*a* of FIG. 12. The connecting conduit 200 conveys effluent from the assembly 20*a* which has been processed in the same manner as in the assembly 20 and is interconnected with a conventional existing sewage pipe at one remote location (not shown). Assembly 20*a* is similar in operation and internal structure as assembly 20 and thus is designed to be located at some distance from a waste pipe without the need of special conduit modifications to existing conventional plumbing installations. For example, by providing a ¼ inch pitch per foot to conduit 200, the distance to the waste pipe could be more than 20 feet and assembly 20*a* would still operate satisfactorily. With a system of this type, it can be used as a temporary toilet for an invalid or an elderly person. It also lends itself to installation by a do-it-yourselfer as an additional toilet in a bedroom or an attic or any other remote location.

Figure 13:
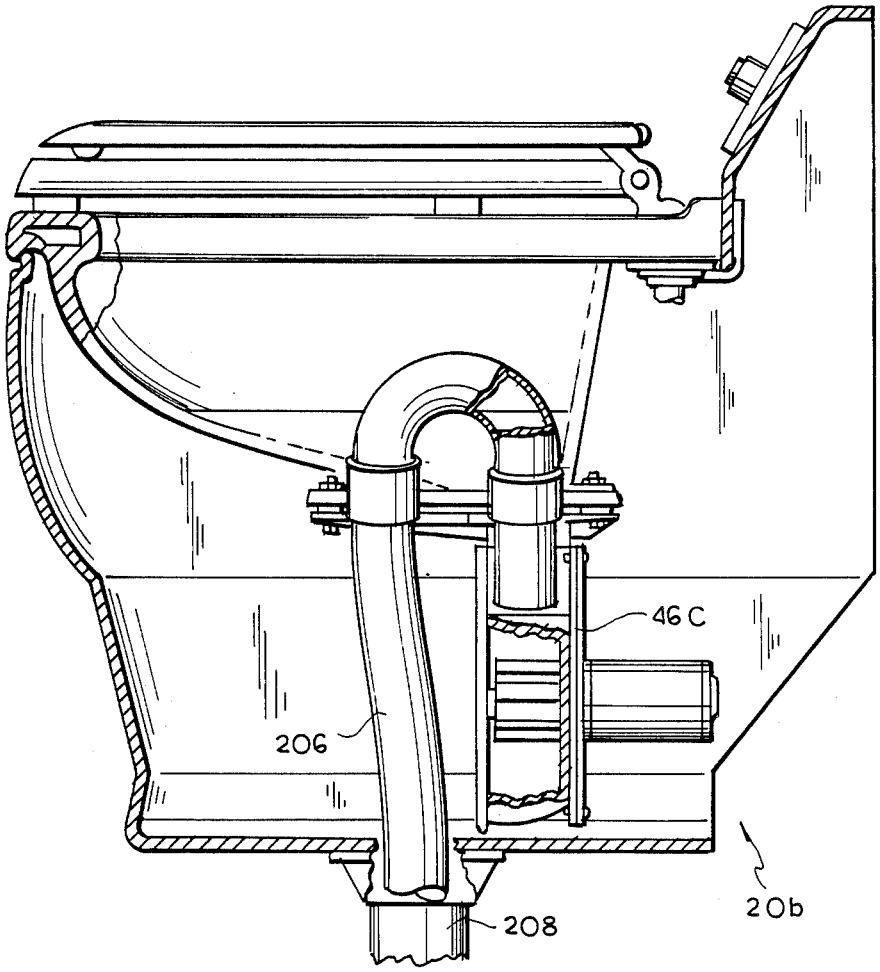
FIG. 13 is a sectional side elevation view of a second alternative embodiment of the sewage waste disposal system of the invention showing a standard toilet installation with water usage of less than 3 quarts.
Figure 14:
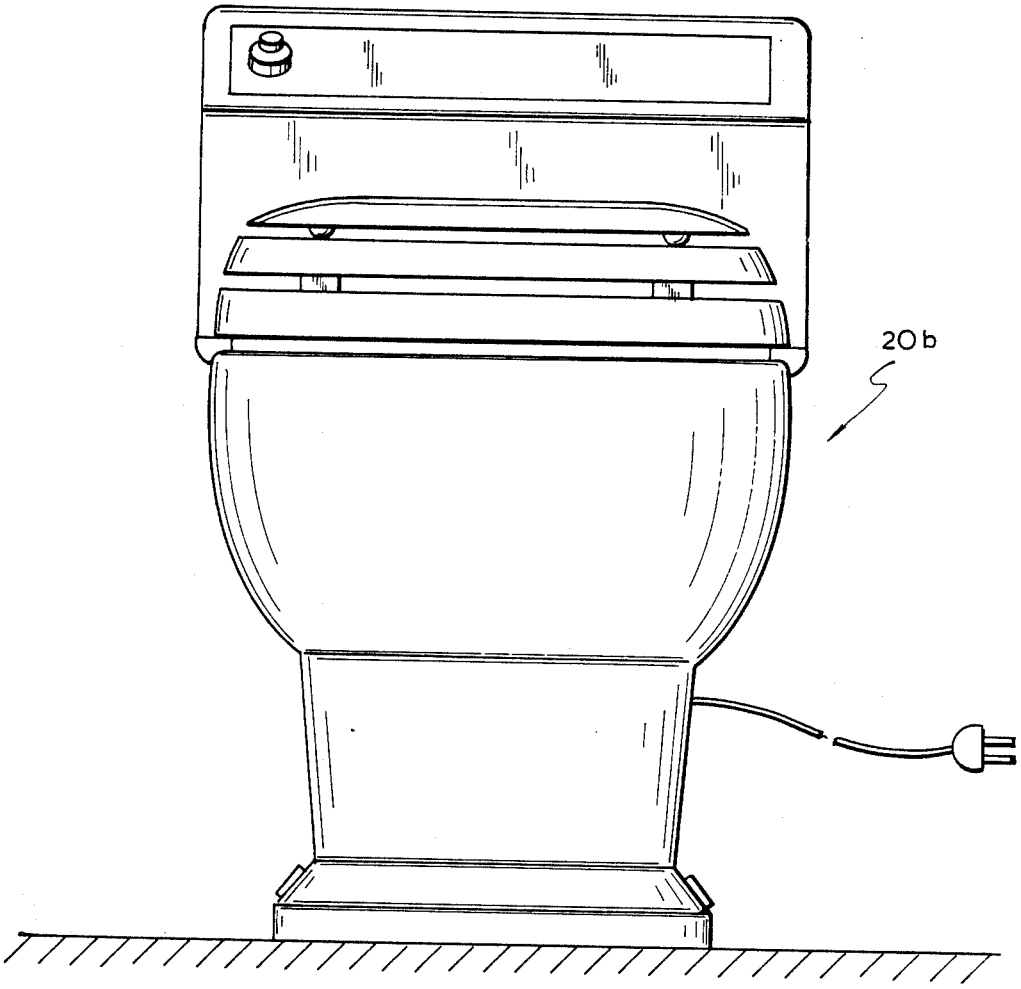
FIG. 14 is a front elevation view thereof.

The embodiment of FIGS. 13 and 14 shows how an assembly such as depicted and described in connection with assemblies 20 and 20*a* can be constructed in a similar manner to form an assembly 20*b* to be used to cut the water volume per flush from 5 or 3½ gallons to ½ gallon. The only modification is that the macerator pump assembly 46*c* directs the effluent through the conduit arrangement 205 directly to a conventional four inch outlet pipe 208 mounted in a conventional manner to the bottom of assembly 20*b*.

Figure 5:
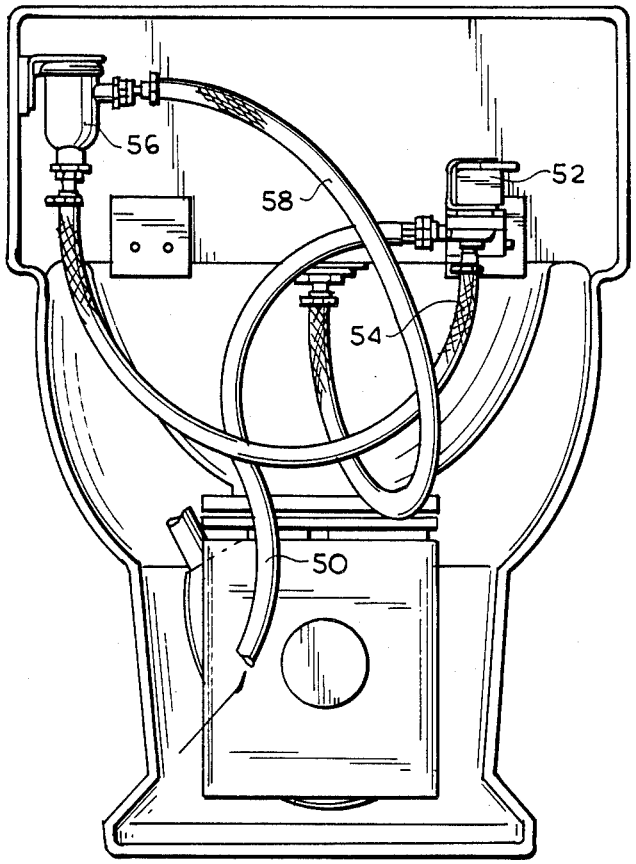
FIG. 5 is a sectional rear view thereof.

All of the embodiments are supplied with appropriate connectors for direct interconnection with convention water supply lines. As shown in FIG. 5 in connection with system 20, an inlet hose 50 receiving water from the water supply source is coupled with the electrically operated flush valve 52.

A hose 54 connects the flush valve with an anti-syphon valve 56. Another hose 58 connects the anti-syphon valve 56 with the flush rim on the bowl assembly for introduction of water therein and prevention of back flow. Similar connections can be made to system 20*a* and 20*b*.

In operation, as discussed above, depression of flush button 80 on the front of the housing will start the electrical cycle during which the flush valve 52 will be opened and water will be pushed through hoses 50, 54 and 58 into the bowl to rinse and refill the bowl and from the bowl into the macerator assembly for maceration of waste and then from the assembly through discharge conduits for disposal as effluent.

Assembly 20 relating to use in basement locations employs quick and simple connection means for interconnection with an existing elevated sewer or septic line. A conventional 1½ inch discharge pipe can be extended between the bottom rear of the assembly to the elevated location and interconnected with a suitable adapter and a sanitary "Y" connector. The water supply connection on the unit is adapted to receive a conventional ½ inch water supply hose and the electrical connections are conventional 120 volts ac, 60 hertz, 5 amperes. The compact unit can be constructed of 21 inch height, 22 inch length and 16 inch width thereby using a minimum amount of space in the basement location.

Assembly 20*a* relating to remote locations is similar in structure and operation and can be interconnected by a conventional ½ inch water supply line and a 1½ inch discharge pipe. The electrical supply is a conventional 120 volts ac, 60 hertz, 5 amperes. The 1½ inch discharge pipe is elevated up to a 10 foot maximum height and then over while the hose slopes down at ¼ inch per foot rate to a conventional adapter for use with a sanitary "Y" to interconnect an existing sewer or septic line. lo Assembly 20*b* which is a particular design useful in water saver applications also employs standard 120 volts ac, 60 hertz, 5 amperes electrical supply and utilizes a conventional ½ inch water supply.

The depicted embodiments can be modified in an additional way. Instead of using a direct household water line, a water closet or storage tank can be mounted on the unit and directly interconnect with the the bowl in a conventional manner. Conventional connections would be provided for supplying water to the water closet preparatory to each flush cycle.

Thus the several aforenoted objects and advantages are most effectively attained. Although several somewhat preferred embodiments have been disclosed and described in detail herein, it should be understood that this invention is in no sense limited thereby and its scope is to be determined by that of the appended claims.

We claim:

1. A self-contained toilet system comprising: a housing structure, a toilet bowl mounted on the housing structure adapted to receive human waste and fluid for diluting the waste, a rinse and refill means interconnected with the toilet bowl, discharge means for removing effluent fluid from the system, a macerator pump in the housing in direct communication with the bowl for receiving the contents thereof and for conditioning the waste for direct discharge from the system by the discharge means control means to direct fluid through the system and to facilitate the handling of waste and transportation of the treated waste to the exterior of the system in a timed sequence, the macerator pump including a body having walls defining an interior cavity, a block mounted in the cavity with a macerating surface therein projecting into the cavity, a rotatable impeller in the cavity of the body with a plurality of blades thereon and at least the tip portion of each blade being flexible and adapted to rotate and cooperatively mate only with the projecting macerating surface of the block while being spaced from said walls to macerate solids and provide pumping action to project and lift the macerated solids and liquids accumulated therewith from the system to an elevated or remote location, the pump body having an inlet orifice on one side of said projecting macerating surface and an outlet orifice on the opposite side of said projecting macerating surface for transportation of the effluent therethrough, so that the effluent enters the inlet and a portion thereof is directed through the outlet, a further portion of the effluent contacts the mating blades and blocks so that soft solids are macerated and chopped and the further portion of effluent is then pumped from the pump body through the outlet orifice with the pumping action being enhanced by the cooperative action between the block and rotating blades, and the flexible blades enabling the handling and pumping through the outlet orifice of non-macerable solid objects introduced through the inlet orifice.

2. The invention in accordance with claim 1 wherein the discharge means includes a conduit for transporting effluent fluid from the macerator to an elevated position exterior to the system.

3. The invention in accordance with claim 2 wherein a discharge conduit for the effluent fluid extends from the housing upward approximately 10 feet, is approximately 1½ inch in diameter and is adapted to be interconnected with an existing sewer or septic line.

4. The invention in accordance with claim 1 wherein the discharge means includes conduit means for transporting the effluent fluid from the system to a remote location.

5. The invention in accordance with claim 4 wherein a discharge conduit extends from the housing for disposal of effluent fluid upward approximately up to 10 feet and then tapers from the horizontal approximately ¼ inch per foot on a down slope to a remote location where it is adapted to be interconnected with an existing sewer or septic line.

6. The invention in accordance with claim 1 wherein only a small amount of fluid is required per flush.

7. The invention in accordance with claim 4 wherein only approximately ½ gallon of fluid is required per flush.

8. The invention in accordance with claim 6 wherein the effluent fluid is discharged through the bottom of the housing directly to an existing sewer of septic line.

9. The invention in accordance with claim 1 wherein the macerating surface on the block is V-shaped and formed with an acute angle.

10. The invention in accordance with claim 1 wherein the macerating surface on the block is V-shaped and formed at an obtuse angle.

11. The invention in accordance with claim 1 wherein the fluid for each flush is introduced directly to the toilet bowl in the system from a source exterior of the housing.

12. The invention in accordance with claim 1 wherein the macerating surface on the block has an arcuate configuration.

13. The invention in accordance with claim 1 wherein the cutting surface on the block has a tapered curved configuration.

* * * * *